US010996036B1

(12) United States Patent
Brookman

(10) Patent No.: US 10,996,036 B1
(45) Date of Patent: May 4, 2021

(54) SABOT AND PROJECTILE WITH IMPROVED COUPLING FOR BETTER TORQUE TRANSFER

(71) Applicant: Marc Arthur Brookman, Livonia, MI (US)

(72) Inventor: Marc Arthur Brookman, Livonia, MI (US)

(73) Assignee: Quality Engineered Polymer Products Inc., Livonia, MI (US)

( * ) Notice: Subject to any disclaimer, the term of this patent is extended or adjusted under 35 U.S.C. 154(b) by 0 days.

(21) Appl. No.: 16/690,003

(22) Filed: Nov. 20, 2019

(51) Int. Cl.
*F42B 14/06* (2006.01)

(52) U.S. Cl.
CPC ..... *F42B 14/064* (2013.01); *F42B 14/068* (2013.01)

(58) Field of Classification Search
CPC ..... F42B 14/064; F42B 14/068
USPC ..... 102/522
See application file for complete search history.

(56) References Cited

U.S. PATENT DOCUMENTS 3,894,492 A * 7/1975 Barr ..... F42B 14/064 102/520
4,881,466 A * 11/1989 McGinley ..... F42B 14/064 102/522
5,182,419 A * 1/1993 Burnette ..... F42B 14/064 102/523
9,587,918 B1 * 3/2017 Burrow ..... F42B 12/78

* cited by examiner

*Primary Examiner* — Samir Abdosh

(57) ABSTRACT

A self-separating sabot-projectile assembly with a positive engaging attachment to eliminate rotational slippage between the sabot and projectile. The torque transmitting interface between the sabot and projectile consists of a geometric shaped depression in the rearward end surface of the projectile which mates with a matched projection of the sabot. The sabot projection is hollowed out to allow the charge pressure to aid in the engagement of the sabot and projectile.

20 Claims, 7 Drawing Sheets

SABOT AND PROJECTILE WITH IMPROVED COUPLING FOR BETTER TORQUE TRANSFER

FIELD OF THE INVENTION

This invention relates to a projectile and sabot assembly to be fired from a firearm.

SUMMARY OF THE INVENTION

An object of this invention is to create a sabot-projectile system with improved coupling for increased torque transmission but once exiting the barrel of the firearm, quickly and easily separates apart as to not inhibit the speed or accuracy of said projectile.

A feature of this invention is the mating geometric shape in the rearward end of the projectile and inside bottom surface of the sabot where the sabot geometric shape is hollowed to allow the pressure from the exploding propellant to enhance the engagement between the sabot and projectile.

BACKGROUND OF THE INVENTION

For conical shaped projectiles to fly stable, they must spin along their longitudinal axis as they travel forward. A number of factors determine the required stabilizing rotational velocity such as forward velocity, projectile geometry, and projectile mass. With breach loaded, cartridge type firearms the projectiles themselves engage with the rifling of the barrel to create the required rotational velocity. This is commonly referred to as "twist rate" or "rate of twist" and listed as 1 in X. X being the number of inches it takes the barrel groves to complete one revolution.

Two piece sabot-projectile assemblies are commonly used for muzzle loading firearms and shotguns. The sabot acts as a centering device to hold the projectile concentric within the barrel as well as creating a pressure seal to reduce explosion gas leakage to optimize projectile velocity for a given charge. The sabot also engages in the rifling of the barrel and imparts a rotational force to the projectile.

Many of these assemblies have smooth mating surfaces which can allow for a significant amount of rotational slippage. A few assemblies utilize small splines on the rear edge of the outside surface of the projectile that mate to similar splines inside the sabot pocket while others use a slot, cross or other shaped protrusion/pocket arraignment.

Because of the extremely high rotational inertial forces created when a projectile is accelerated down a rifled barrel, the small splines or plastic protrusions cannot always withstand the forces or still have some amount of slip resulting in less than optimal spinning of the projectile. They can also impede the separation of the sabot and projectile or are designed not to separate from the projectile. The advantage of the present invention will be apparent from the following specification taken in conjunction with the claims and drawings appended hereto.

DESCRIPTION OF THE INVENTION

Detailed Description

The assembly has a projectile with a geometric impression on the rearward end surface and a sabot with a geometrically mating protrusion on the inside lower surface of said sabot. The sabot protrusion is created such that the bottom surface of said protrusion is a hollow pocket of the same or different geometry offset by a wall thickness of the sabot. Furthermore the Sabot has longitudinal slots in the pocket that holds the projectile. These slots allow for easy separation of the sabot from the projectile once it leaves the barrel of the firearm. The geometric shape as described can be of any number of surfaces.

Figure 1:
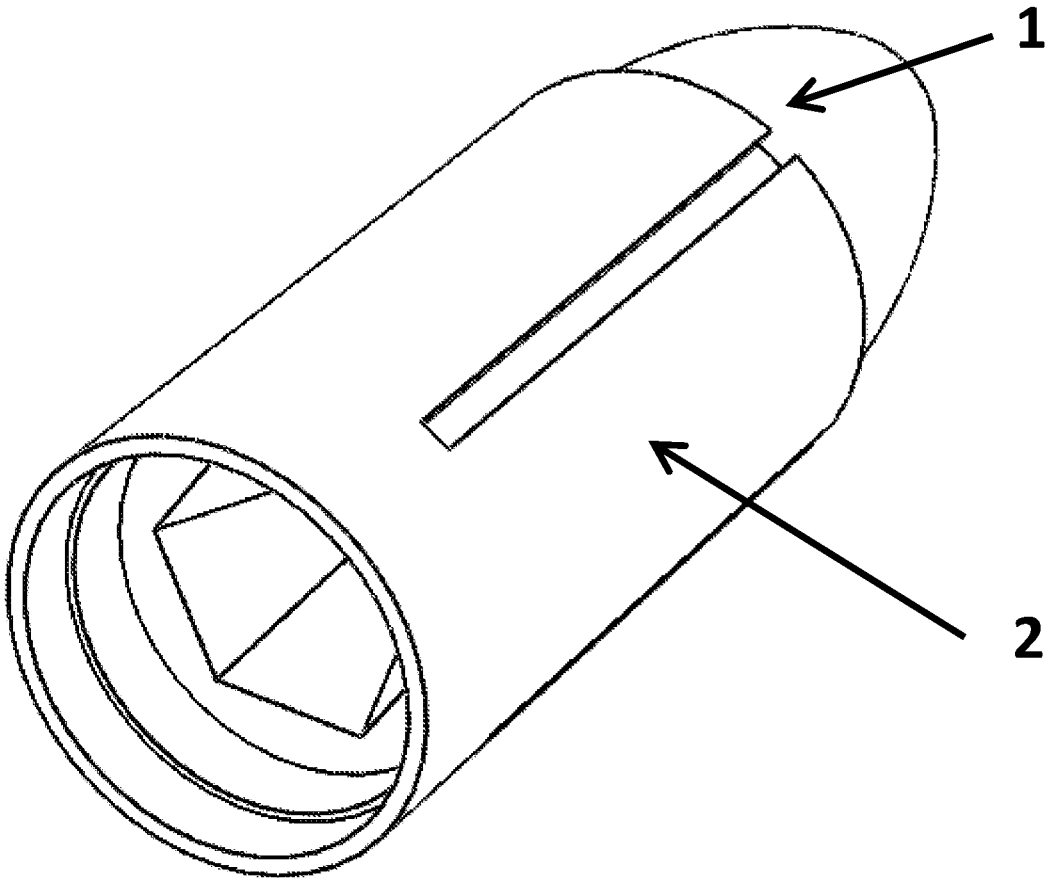
FIG. 1 is a rear perspective view of the assembly of the present invention.
Figure 2:
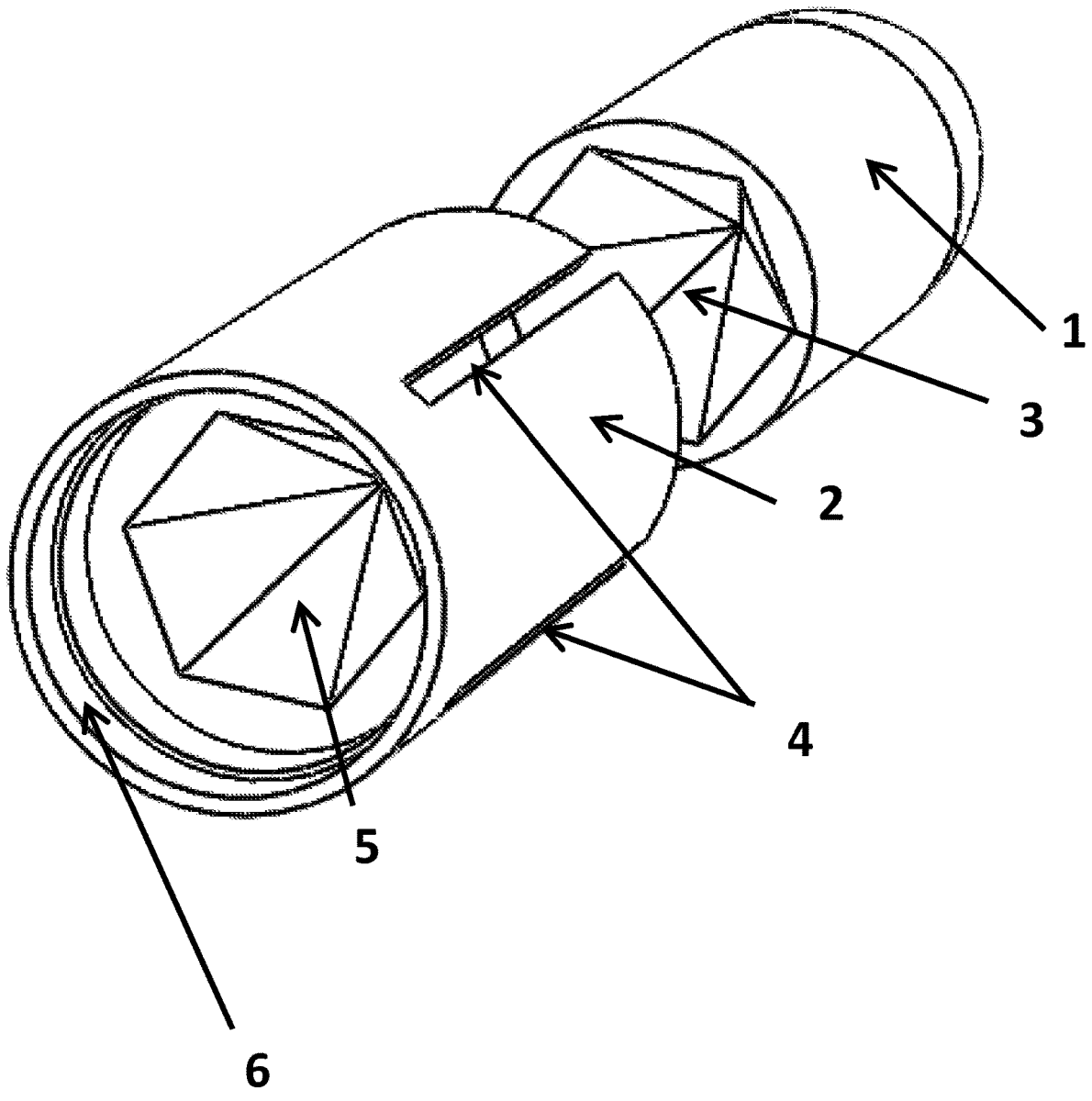
FIG. 2 is an exploded rear perspective view of the assembly of the present invention.
Figure 3:
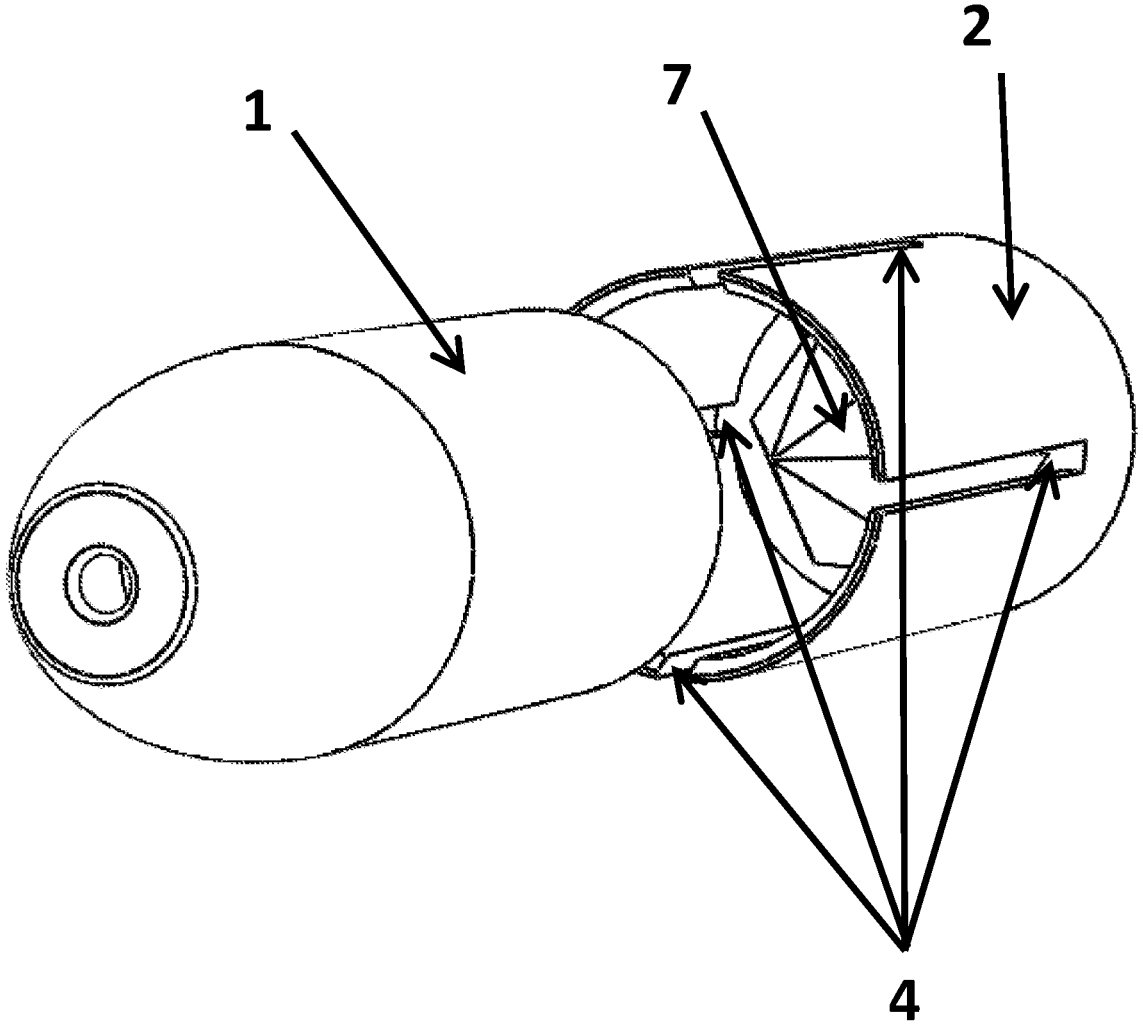
FIG. 3 is an exploded front perspective view of the assembly of the present invention.
Figure 4:
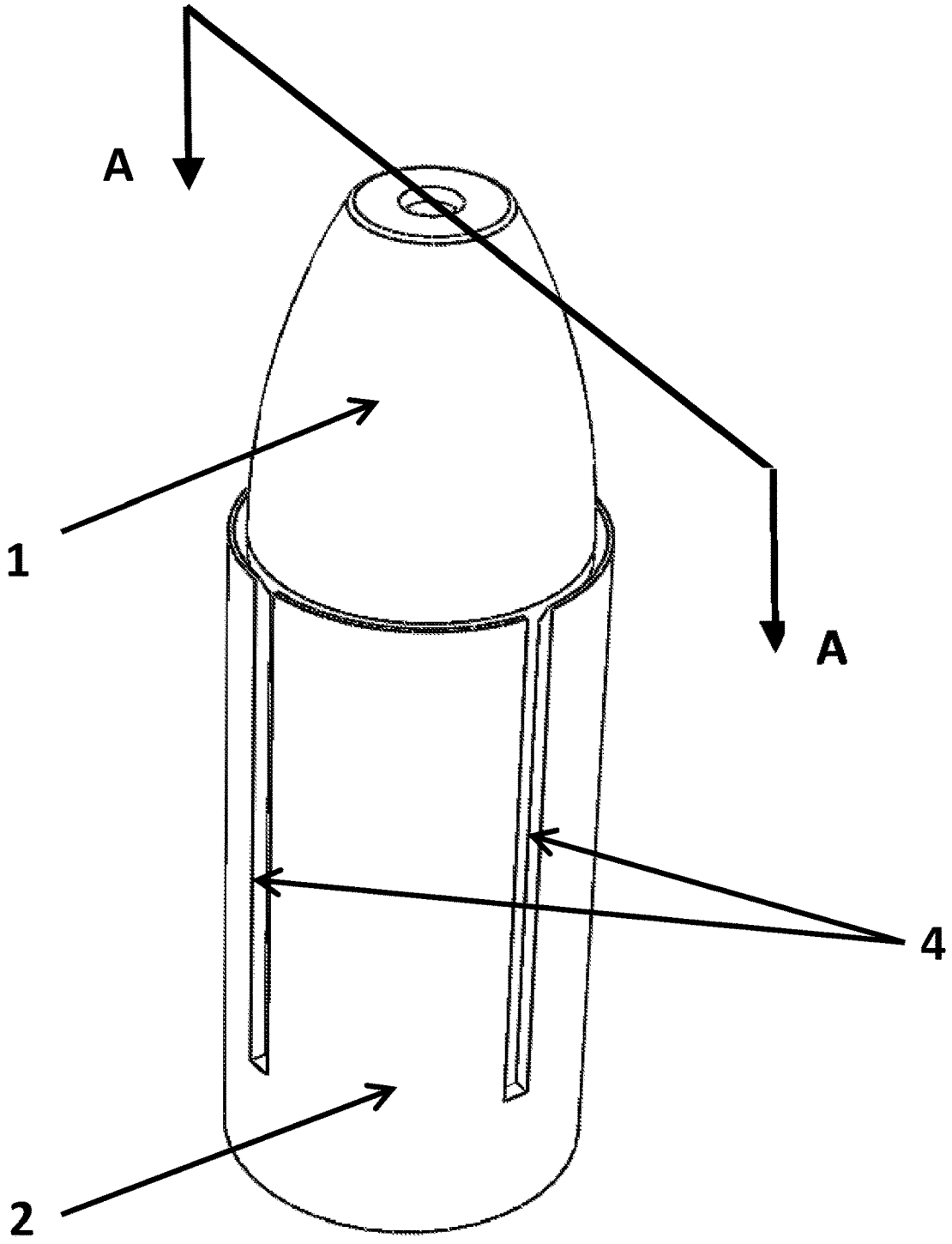
FIG. 4 is an isometric view of the present invention.
Figure 5:
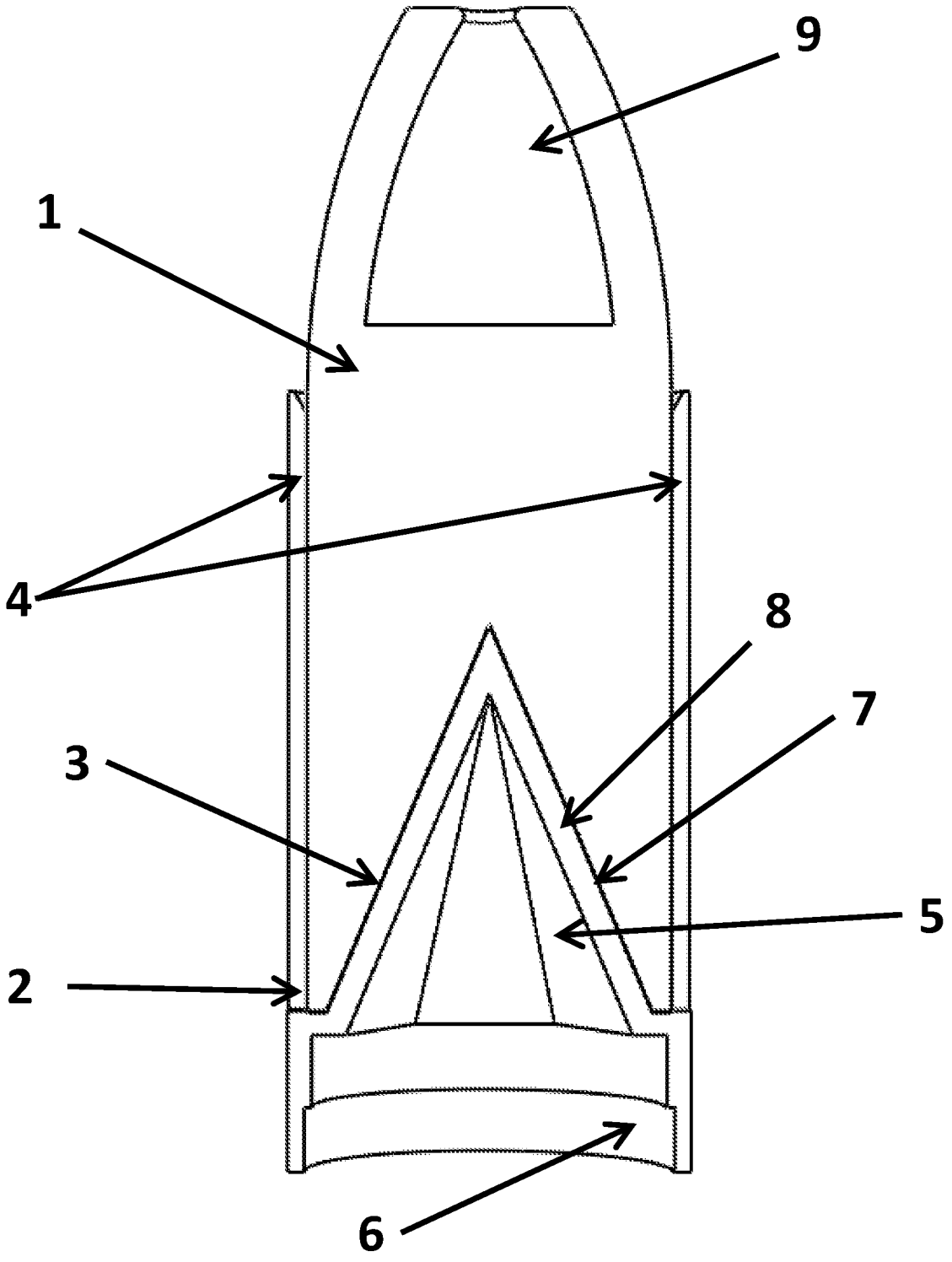
FIG. 5 is an axial section view along A-A of FIG. 4.
Figure 6:
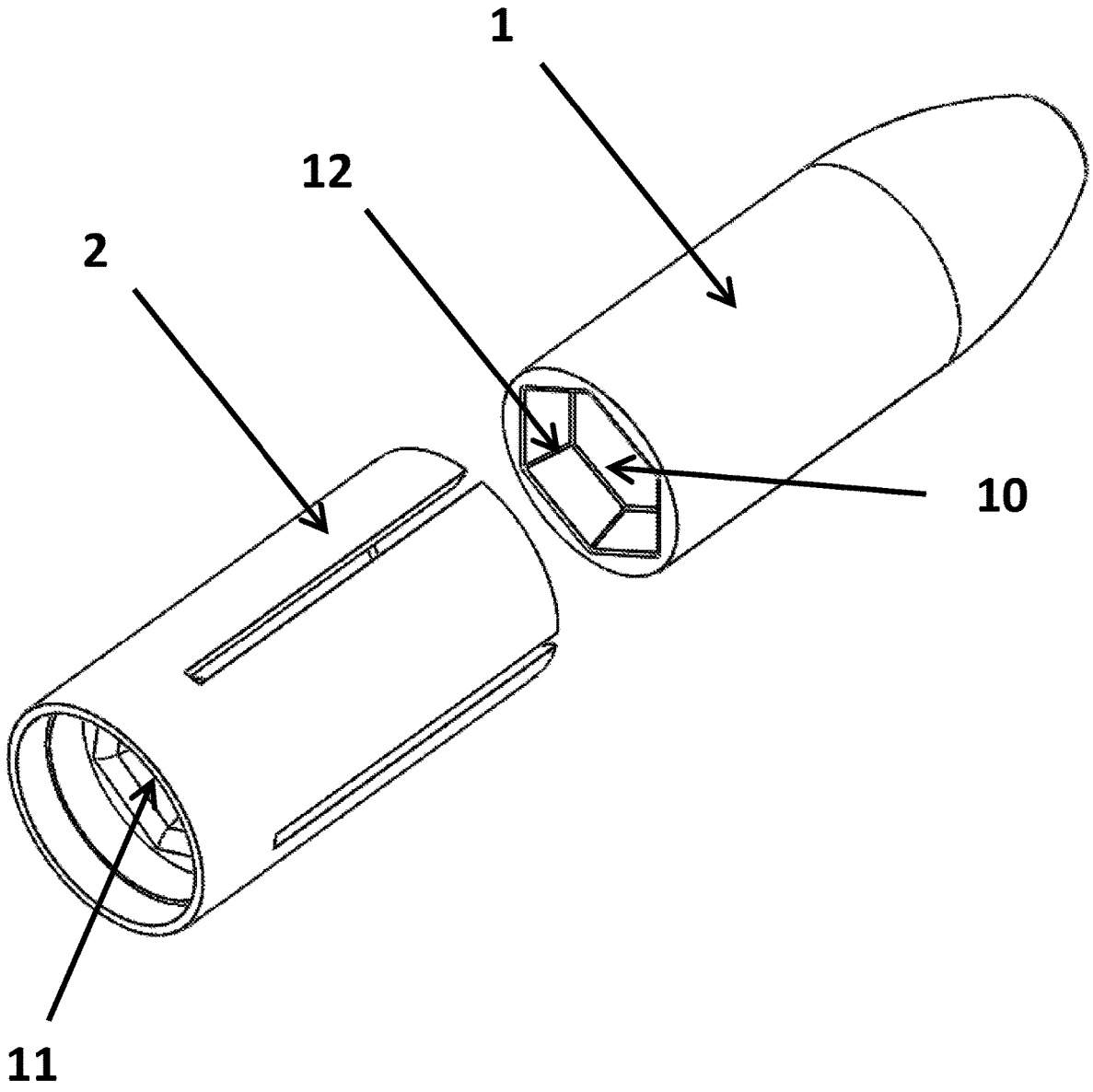
FIG. 6 is an exploded rear perspective view of an alternative design of the present invention.
Figure 7:
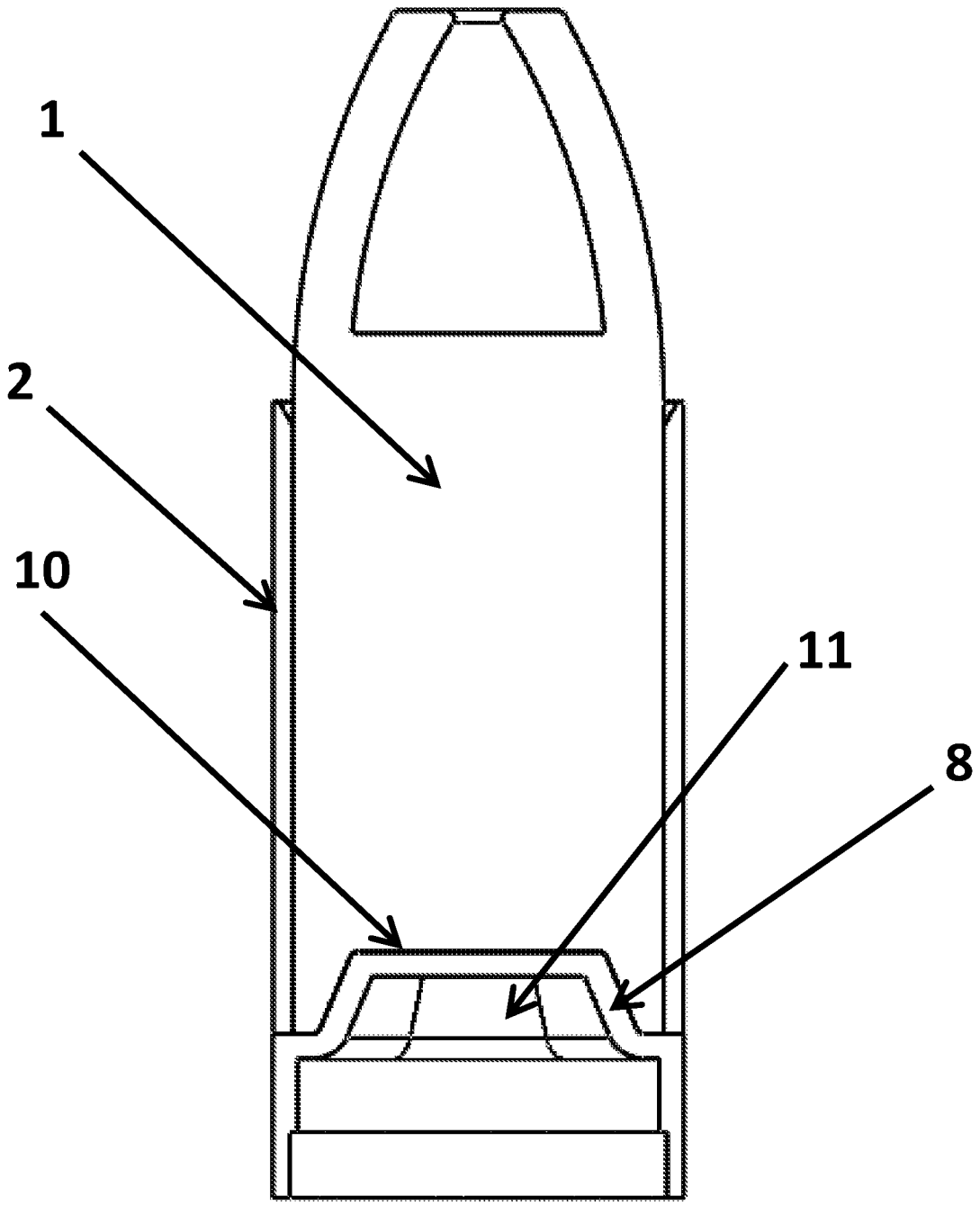
FIG. 7 is an axial section view along A-A of FIG. 4 of an alternative design of the present invention.

Referring to FIG. 1, you can see the projectile 1 and sabot 2 in assembly. In FIG. 2 a pyramid shaped hollowed pocket 3 of the projectile 1 is clearly shown. Also shown in FIG. 2 are the longitudinal slots 4, a pyramid shaped impression 5 of sabot 2, and stepped pressure seal skirt 6. The pyramid shaped impression 5 is formed by plural, substantially planar facets as clearly illustrated in the drawings. The exploded front perspective view of the assembly in FIG. 3 shows the pyramid shaped protrusion 7 of sabot 2. The pyramid shaped protrusion 7 is formed by plural, substantially planar facets as clearly illustrated in the drawings. As will become apparent, the pyramid pocket 3 of projectile 1 and pyramid shaped protrusion 7 of the sabot mate upon assembly. The hollow pocket 5 on the bottom surface of sabot 2 being is shown as an offset pocked to the pyramid shaped protrusion 7. This hollow pocket allows the pressure of the exploding propellant to create positive coupling. This coupling creates positive engagement and zero slip between the sabot 2 and projectile 1 and thus will improve projectile down range accuracy. It should be noted that the pocket 5 does not need to be of the same geometric shape as protrusion 7. In FIG. 5 you can see the sabot wall 8 that creates the pyramid shaped protrusion 7 and pyramid shaped impression 5. Also in FIG. 5 is a hollow pocket 9 of projectile 1. Such hollow pockets are very common in modern projectiles and aid in the expansion of the projectile and in turn transferring of the projectile energy to the target. These pockets are sometimes left hollow or filled with a polymer. FIG. 6 shows an alternative geometric shaped pocket in the rearward end of the projectile 1 in the form of a truncated pyramid 10, i.e., the truncated pyramid shaped impression of the projectile is formed by plural, substantially planar facets as clearly illustrated in the drawings. Similarly you can see a truncated pyramid pocket 11 in the bottom surface of the Sabot 2, i.e., the truncated pyramid shaped protrusion of the sabot is formed by plural, substantially planar facets as clearly illustrated in the drawings. Also in FIG. 6 you can see radii edges 12 of the geometric shape. These radii edges can aid in the manufacturer of the assembly as well as aid in separation of the sabot from the projectile. In FIG. 7 you can see the truncated pyramid pocket 10 of the projectile, truncated pyramid pocket 11 of the sabot and the sabot wall 8 in section.

Clearly, minor changes may be made in the shape and construction of the invention described without departing from the material spirit thereof. It is desired that the invention shown and described herein not be limited to its exact form, but allowed to include all such as properly come within the scope claimed.

What is claimed is:

1. A sabot-projectile assembly, comprising:

a projectile with;

a geometric shaped impression in a central region of a reward surface to accept a mating, central protrusion of the sabot a sabot with;

a longitudinally slotted extended bore for receiving the projectile and easily releasing from the projectile; and a base having a geometric shaped protrusion that mates with the projectile and a hollowed pocket to allow the pressure from the exploding charge to enhance the engagement to the projectile for improved torque transmission.

2. A sabot-projectile assembly according to claim 1, where the geometric shaped pocket of the projectile, sabot protrusion, and sabot hollow pocket are pyramids.

3. A sabot-projectile assembly according to claim 1, where the geometric shaped pocket of the projectile, sabot protrusion, and/or sabot hollow pocket are a truncated pyramid.

4. A sabot-projectile assembly according to claim 1, where the projectile is made from a metallic material.

5. A sabot-projectile assembly according to claim 1, where the projectile is made from a polymeric material.

6. A sabot-projectile assembly according to claim 1, where the projectile is made from a metal-polymeric composite material.

7. A sabot-projectile assembly according to claim 1, where the sabot is made from a polymeric material.

8. A sabot-projectile assembly, comprising:

a projectile with;

a geometric shaped impression in the rearward surface to accept a mating protrusion of the sabot a one-piece sabot with;

a longitudinally slotted extended bow for receiving the projectile and easily releasing from the projectile; and a base having a geometric shaped protrusion that mates with the projectile and a hollowed pocket to allow the pressure from the exploding charge to enhance the engagement to the projectile for improved torque transmission, where the geometric shaped impression of the projectile, sabot protrusion, and/or sabot hollow pocket have radii edges.

9. A sabot-projectile assembly, comprising:

a projectile with;

a geometric shaped impression in the rearward surface to accept a mating protrusion of the sabot a one-piece sabot with;

a longitudinally slotted extended bore for receiving the projectile and easily releasing from the projectile; and a base having a geometric shaped protrusion that mates with the projectile and a hollowed pocket to allow the pressure from the exploding charge to enhance the engagement to the projectile for improved torque transmission, where the pyramid pocket of the projectile, sabot protrusion, and/or sabot hollow pocket have radii edges.

10. A sabot-projectile assembly according to claim 2, where the projectile is made from a metallic material.

11. A sabot-projectile assembly according to claim 2, where the projectile is made from a polymeric material.

12. A sabot-projectile assembly according to claim 2, where the projectile is made from a metal-polymeric composite material.

13. A sabot-projectile assembly according to claim 2, where the sabot is made from a polymeric material.

14. A sabot-projectile assembly according to claim 1, where the sabot is one-piece.

15. A sabot-projectile assembly according to claim 1, where the geometric shaped pocket of the projectile, sabot protrusion, and sabot hollow pocket include multiple facets.

16. A sabot-projectile assembly according to claim 15, where the facets of the pyramid pocket of the projectile, sabot protrusion, and/or sabot hollow pocket have radii edges.

17. A sabot-projectile assembly according to claim 1, where the geometric shaped pocket of the projectile, sabot protrusion, and sabot hollow pocket are pyramid shaped.

18. A sabot-projectile assembly according to claim 17, where the geometric shaped pocket of the projectile, sabot protrusion, and sabot hollow pocket include multiple facets.

19. A sabot-projectile assembly according to claim 17, where the pyramid shape facets of the pyramid pocket of the projectile, sabot protrusion, and/or sabot hollow pocket have radii edges.

20. A sabot-projectile assembly according to claim 2, where the geometric shaped pocket of the projectile, sabot protrusion, and sabot hollow pocket are pyramids that include multiple facets having radii edges.

* * * * *